US012543853B2

(12) United States Patent
Liao et al.

(10) Patent No.: US 12,543,853 B2
(45) Date of Patent: Feb. 10, 2026

(54) SPRING PRESSURE DEVICE SET AND SLIDE RAIL ASSEMBLY USING SAME

(71) Applicant: Nan Juen International Co., Ltd., Taoyuan (TW)

(72) Inventors: Wei-Liang Liao, Taoyuan (TW); Tzung-Ying Hsieh, Taoyuan (TW)

(73) Assignee: NAN JUEN INTERNATIONAL CO., LTD., Taoyuan (TW)

( * ) Notice: Subject to any disclaimer, the term of this patent is extended or adjusted under 35 U.S.C. 154(b) by 77 days.

(21) Appl. No.: 18/603,199

(22) Filed: Mar. 12, 2024

(65) Prior Publication Data

US 2025/0288105 A1 Sep. 18, 2025

(51) Int. Cl.
*A47B 88/463* (2017.01)

(52) U.S. Cl.
CPC ..... *A47B 88/463* (2017.01)

(58) Field of Classification Search
CPC ..... A47B 88/463; A47B 88/46; A47B 88/467; A47B 88/47
See application file for complete search history.

(56) References Cited

U.S. PATENT DOCUMENTS 7,347,515 B1 * 3/2008 Lu ..... A47B 88/463 312/319.1
7,481,505 B2 * 1/2009 Orita ..... A47B 88/467 312/333
8,469,468 B2 * 6/2013 Chen ..... A47B 88/463 312/334.47
8,556,305 B2 * 10/2013 Juan ..... A47B 88/463 292/164
8,632,142 B2 * 1/2014 Park ..... A47B 88/467 312/334.6
8,807,671 B2 * 8/2014 Brunnmayr ..... A47B 88/57 312/319.1
8,899,703 B2 * 12/2014 Chung ..... A47B 88/463 312/334.8
8,939,525 B1 * 1/2015 Chen ..... A47B 88/467 312/333
9,532,648 B2 * 1/2017 Gasser ..... A47B 88/437
(Continued)

FOREIGN PATENT DOCUMENTS

CN 112841951 A * 5/2021 ..... A47B 88/463
CN 113208322 A * 8/2021 ..... A47B 88/477
(Continued)

*Primary Examiner* — Hanh V Tran
(74) *Attorney, Agent, or Firm* — MUNCY, GEISSLER, OLDS & LOWE, P.C.

(57) ABSTRACT

A slide rail assembly includes a spring pressure device set including a base member with a stroke path and a step path, an elastic member, a slider and a control rod, and a slide rail including a first rail and a second rail with an activating member. The control rod moves on the stroke path and step path, allowing the slider to store elastic force through the stretch of the elastic member, and the slider to pop up through the elastic force of the elastic member. The spring pressure device set is installed on the first rail. When the second rail is received in the first rail, the activating member drives the slider and the control rod is locked at the base member. When the activating member is pushed, the control rod is unlocked, and the elastic member pops the slider out of the second rail.

10 Claims, 18 Drawing Sheets

(56) References Cited

U.S. PATENT DOCUMENTS

| | | | | |
|---|---|---|---|---|
| 9,648,952 | B2 * | 5/2017 | Nuckolls | A47B 88/487 |
| 9,930,962 | B2 * | 4/2018 | Chen | A47B 88/49 |
| 10,051,963 | B2 * | 8/2018 | Azkue | A47B 88/497 |
| 2009/0091224 | A1 * | 4/2009 | Wu | A47B 88/467<br>312/333 |
| 2015/0063729 | A1 * | 3/2015 | Huang | A47B 88/463<br>384/21 |

FOREIGN PATENT DOCUMENTS

| | | | | | |
|---|---|---|---|---|---|
| CN | 217065778 | U | * | 7/2022 | A47B 88/463 |
| CN | 115363359 | A | * | 11/2022 | A47B 88/49 |
| CN | 115697138 | A | * | 2/2023 | A47B 88/467 |
| CN | 116421012 | A | * | 7/2023 | A47B 88/40 |
| CN | 117530548 | A | * | 2/2024 | A47B 88/40 |
| CN | 117530550 | A | * | 2/2024 | A47B 88/463 |
| DE | 202008001884 | U1 | * | 4/2008 | A47B 88/463 |
| DE | 202009005233 | U1 | * | 1/2011 | A47B 88/463 |
| DE | 102023110428 | A1 | * | 10/2024 | A47B 88/45 |
| JP | 6763704 | B2 | * | 9/2020 | |
| RU | 199551 | U1 | * | 9/2020 | A47B 88/473 |
| WO | WO-2013073489 | A1 | * | 5/2013 | A47B 88/47 |
| WO | WO-2015158766 | A1 | * | 10/2015 | E05F 5/003 |

* cited by examiner

50

50

50

SPRING PRESSURE DEVICE SET AND SLIDE RAIL ASSEMBLY USING SAME

BACKGROUND OF THE INVENTION

1. Field of the Invention

The invention relates to a spring pressure device set and its slide rail assembly, in particular, the hook portion of the control rod moves stably in the stroke path and the step path, so that the slider accumulates elastic force through the stretching of the elastic member, and the slider is ejected by the elastic force of the elastic member.

2. Description of the Related Art

The current cabinet system with pull-out drawers is widely used in various storage devices to facilitate the pull-out operation of the drawers. The drawer is usually used in conjunction with the positioning guides of the slide rails on both sides. In order to facilitate the pull-out operation of the drawer, the slide rail is also equipped with a spring pressing mechanism, so that the drawer can be pushed out slightly by pressing the drawer, thereby facilitating the pull-out operation of the drawer.

SUMMARY OF THE INVENTION

The main object of the present invention is to provide a spring pressure device set and a slide rail assembly using the spring pressure device set in which the spring pressure device set includes a base member forming a stroke path and a step path, an elastic member, a slider and a control rod, and the hook portion of the control rod moves stably in the stroke path and the step path of the base member, so that the slider accumulates elastic force through the stretching of the elastic member, and the slider is ejected by the elastic force of the elastic member.

Another object of the present invention is to provide a spring pressure device set and a slide rail assembly using the spring pressure device set in which the spring pressure device set is installed on the first rail of the slide rail, so that when the second rail of the slide rail is received in the first rail, the activating member of the second rail drives the slider and the hook portion of the control rod is locked at the locking point of the base member, or when the activating member of the second rail is pushed, the activating member of the second rail pushes the slider to unlock the hook portion from the locking point of the base member, causing the elastic member to pop the slider out of the second rail.

In order to achieve the above objects, the technical means adopted in the present invention comprises a base member, an elastic member, a slider, and a control rod. The base member is formed in one piece, comprising a stroke space, a first guide rail located in the stroke space, a locking block with a locking point located on one side thereof, a stroke path formed on the first guide rail and a step path formed around the locking block. The stroke path continues the step path. The elastic member has one end thereof fixed on the base member. The slider is located in the base member and connected to an opposite end of the elastic member. The slider can slide with a lower part thereof along the first guide rail in the stroke space. The control rod is formed of an elastic material in one piece and pivotally connected to the slider to move with the slider. The control rod comprises a hook portion with a curved surface at a tail end thereof so that the hook portion has elastic recovery force. The hook portion is movable from the stroke path to the step path, and when the hook portion deviates from the step path, the elastic restoring force of the hook portion rebounds the hook portion to the step path.

According to the previous characteristics, the step path comprises a lead-in slope, a first guide slope, a second guide slope and a lead-out slope. When the hook portion passes through the lead-in slope to the first guide slope, the hook portion is locked at the locking point, or when the hook portion passes through the second guide slope to the lead-out slope, the hook portion is unlocked from the locking point.

According to the previous characteristics, the base member comprises a second guide rail parallel to the first guide rail. The distance between the first guide rail and the second guide rail is the stroke space, so that the control rod can be limited to the space between the first guide rail and the second guide rail, and the second guide rail can support the upper part of the slider, and the upper part of the slider can be guided by the second guide rail to move stably in the stroke space.

According to the previous characteristics, the slider comprises a groove located on an upper part thereof and a guide surface located on an opposing lower part thereof. When the slider moves to stretch the elastic member, the hook portion is moved to lock at the locking point to generate elastic force on one side of the slider, so that one side of the slider is pushed and the guide surface is pressed against the first guide rail, causing the groove to tilt, or when no push on one side of the slider, the guide surface is kept apart from the first guide rail, causing the groove to face upward.

According to the previous characteristics, the upper part of the slider has a groove. The bottom of the groove forms an elastic rib and one side of the groove forms a barb. The end surface of the elastic rib is extended and bent below the barb.

According to the previous characteristics, the base member further comprises a first fixing hook and a second fixing hook facing the first fixing hook at a rear end thereof, and a positioning block at the rear end of the base member between the first fixing hook and the second fixing hook.

According to the previous characteristics, the slider comprises a groove located on the upper part thereof, a guide block located at a rear side of the groove and a pressing surface adjacent to the groove, and one side of the guide block span the second guide rail.

According to the previous characteristics, the slider further comprises a pressing surface located on one side of upper part thereof above the guide surface.

According to the previous characteristics, the slider further comprises a sliding seat located on the lower part thereof the sliding seat comprises a sliding surface on a top side thereof and a clamping body on a bottom side thereof.

To achieve the above objects, the technical means adopted in the present invention further comprises a slide rail. The slide rail comprises a first rail and a second rail. The first rail provides the spring pressure device set for fixation. The second rail comprises an activating member. When the second rail is received in the first rail, the activating member drives the slider and the hook portion is locked at the locking point. When the second rail is pushed, the activating member pushes the slider and the hook portion is unlocked at the locking point, causing the elastic member to pop the slider out of the second rail.

According to the previous characteristics, when the second rail is received in the first rail, the activating member pushes one side of the slider and the guide surface abuts the first guide rail, causing the groove to tilt. After the activating member reaches the groove, one side of the slider is not pushed and the guide surface does not contact the first guide rail, so that the groove appears upward and the activating member is positioned.

According to the previous characteristics, the groove is rendered facing up while the activating member is positioned. When the second rail is forcefully pulled on the first rail, the activating member abuts the elastic rib, and the elastic rib is displaced so that the barb can hook the activating member.

According to the previous characteristics, the first rail has a bending part, and the first fixing hook, the second fixing hook, and the positioning block are combined on the bending part, so that the rear end of the base member is fixed on the first rail.

With the help of the above-mentioned technology, the spring pressure device set comprises the base member to form the stroke path and the step path, the elastic member, the slider, and the control rod. The hook portion of the control rod moves stably on the stroke path and the step path, allowing the slider to store elastic force through the stretching of the elastic member. In addition, the slider exerts force through the elasticity of the elastic member. The spring pressure device set is installed on the first rail of the slide rail. When the second rail of the slide rail is received in the first rail, the activating member of the second rail drives the slider and locks the hook portion at the locking point of the base member. When the activating member of the second rail is pushed, the activating member of the second rail pushes the slider and unlocks the hook portion from the locking point of the base member with, causing the elastic member to pop the slider out of the second rail.

DETAILED DESCRIPTION OF THE INVENTION

Figure 1:
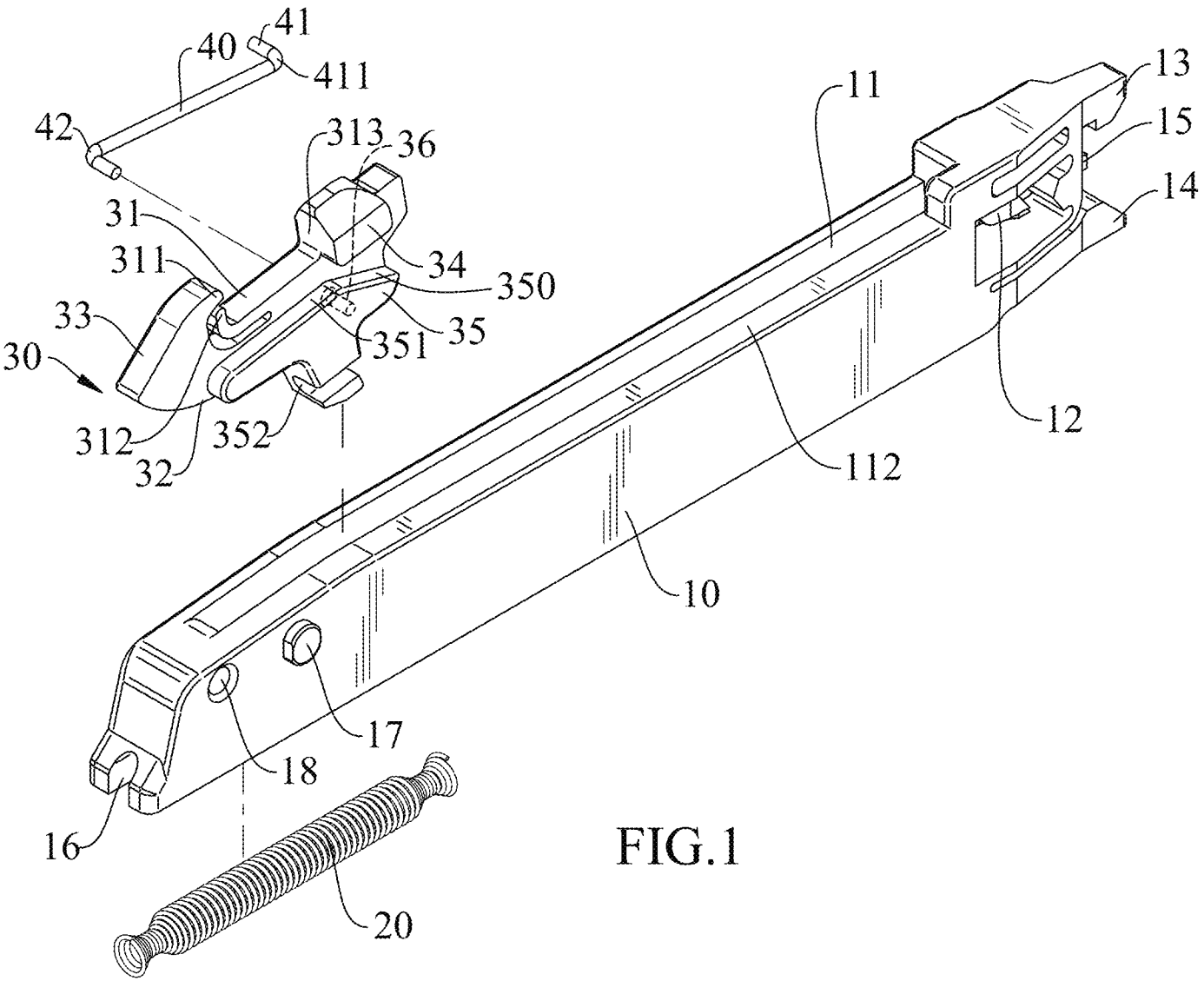
FIG. 1 is an exploded three-dimensional view of the spring pressure device set of the present invention.
Figure 2:
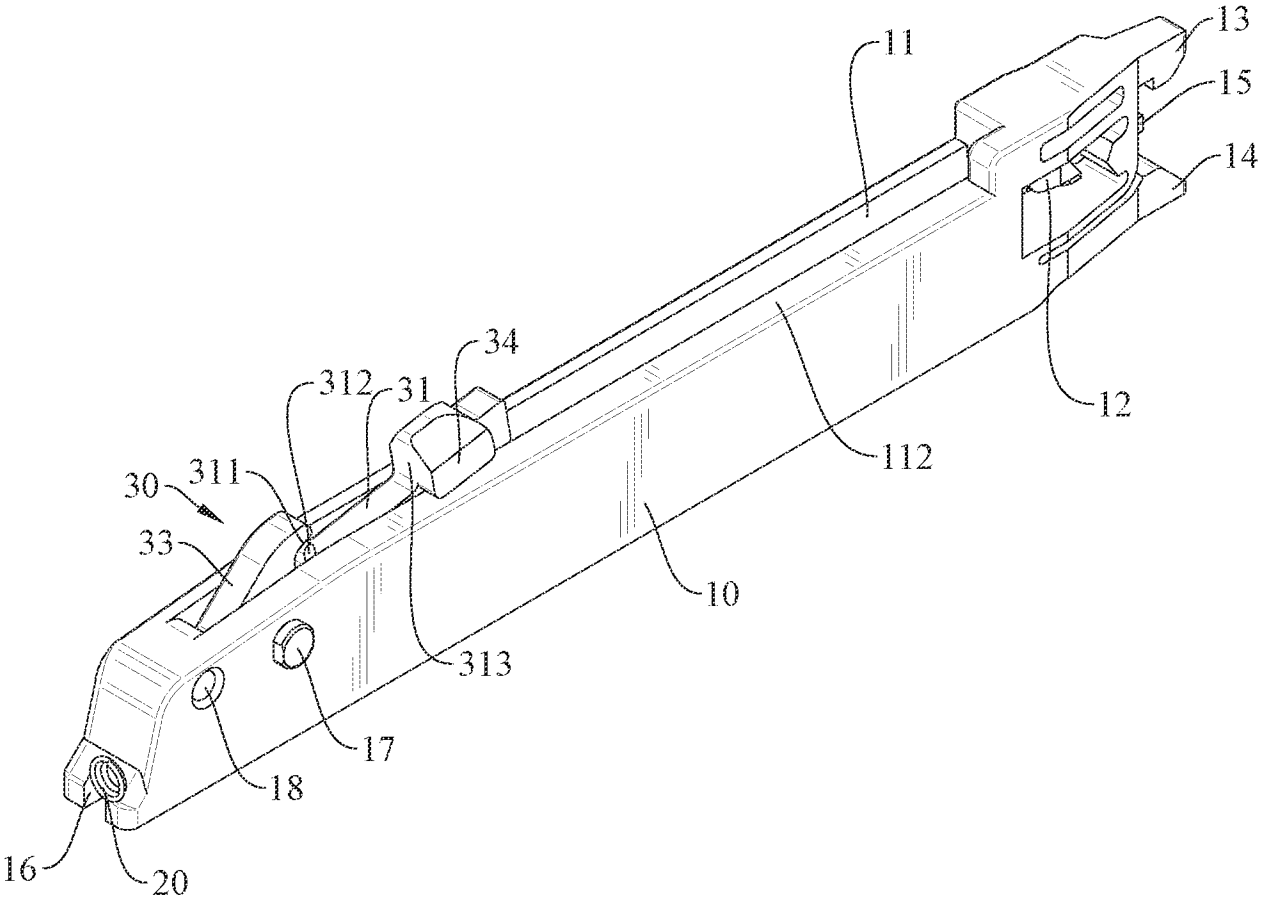
FIG. 2 is a three-dimensional assembly view of the spring pressure device set of the present invention.
Figure 3:
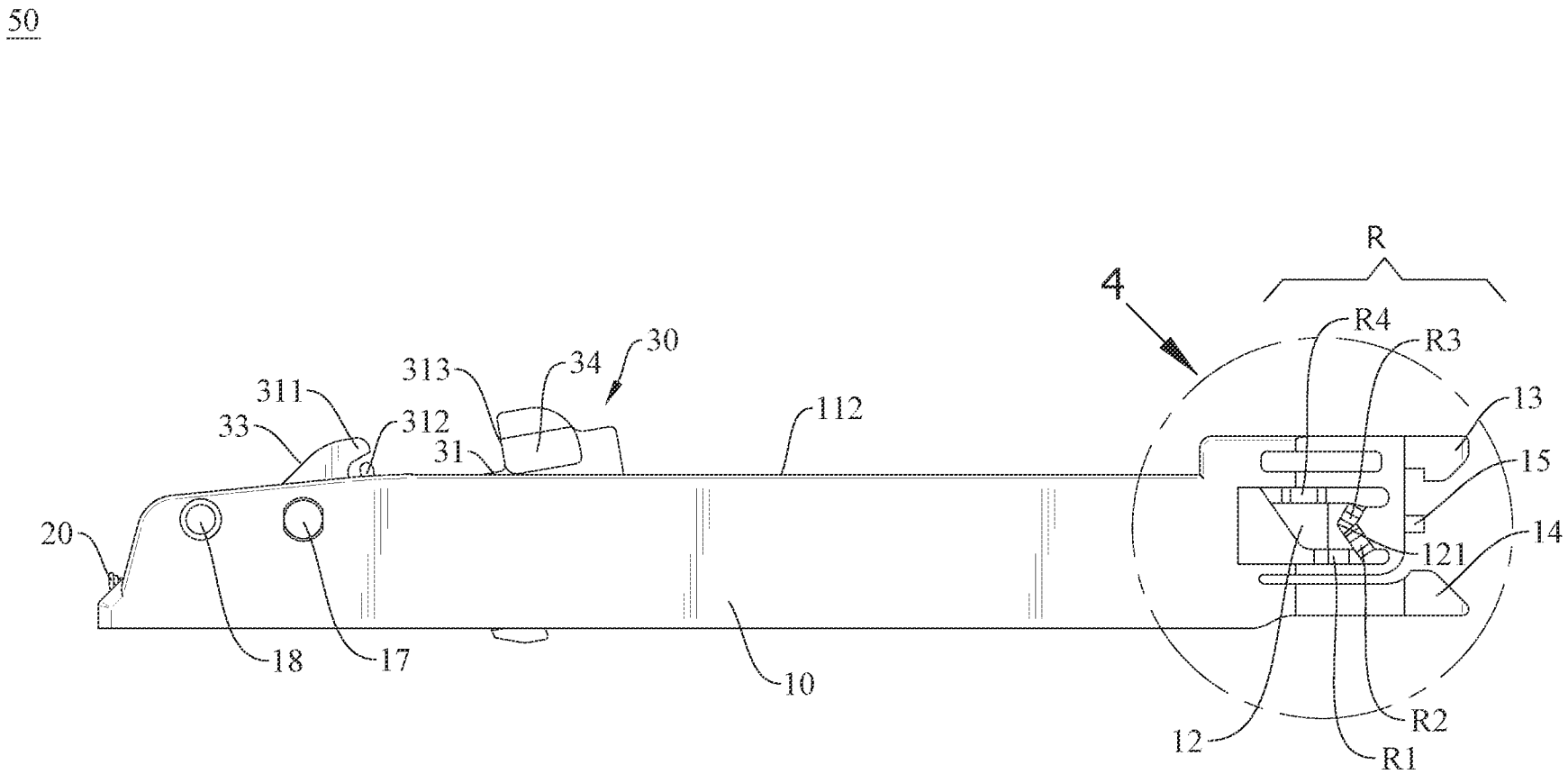
FIG. 3 is a schematic diagram of the slider of the present invention before it moves.

Please refer to FIGS. 1-11. The present invention is a spring pressure device set 50, which comprises: a base member 10, an elastic member 20, and a slider 30, and a control rod 40.

The base member 10 is integrally formed and comprises a stroke space 11 with a first guide rail 111 inside and a locking block 12 with a locking point 121 on one side wall of the base member 10. A stroke path S is formed on the first guide rail 111 and a step path R is formed around the locking block 12, and the stroke path S continues the step path R. In this embodiment, the step path R comprises a lead-in slope R1, a first guide slope R2, a second guide slope R3 and a lead-out slope R4. The lead-in slope R1, the first guide slope R2, the second guide slope R3 and the lead-out slope R4 all have a transverse low section surface L to a vertical high section surface H, and a slope is formed between the transverse low section surface L and the vertical high section surfaces H, so that a step difference is formed between the lead-in slope R1 and the first guide slope R2, a step difference is formed between the first guide slope R2 and the second guide slope R3, and a step difference is formed between the second guide slope R3 and the lead-out slope R4.

Following the above, in this embodiment, the base member 10 further comprises a first fixing hook 13 and a second fixing hooks 14 facing the first fixing hook 13 at the rear end, and a positioning block 15 at the rear end between the first fixing hook 13 and the second fixing hook 14, but is not limited to this. In addition, the base member 10 further comprises a clamping groove 16 at the front end, a positioning member 17 and a fixing hole 18 at one side, and a reinforcement rib 19 at the other side.

The elastic member 20 has one end thereof fixed on the base member 10. In this embodiment, the elastic member 20 can be a spring, and one end of the elastic member 20 is fixed in the clamping groove 16, but this is not used as a limit.

The slider 30 is located in the base member 10 and is connected to the other end of the elastic member 20, and the lower part of the slider 30 can slide along the first guide rail 111 in the stroke space 11. In this embodiment, the base member 10 further comprises a second guide rail 112 parallel to the first guide rail 111. The distance between the first guide rail 111 and the second guide rail 112 is the stroke space 11, so that the control rod 40 can be limited between the first guide rail 111 and the second guide rail 112, and the second guide rail 112 can support the upper part of the slider 30. The upper part of the slider 30 is guided by the second guide rail 112 to move stably in the stroke space 11, but it is not limited to this.

As shown in FIGS. 7, 8, 9, 10 and 11, the upper part of the slider 30 has a groove 31 and the lower part of the slider 30 has a guide surface 32. When the slider 30 moves to stretch the elastic member 20, the hook portion 41 is moved to lock at the locking point 121 to generate elastic force on one side of the slider 30, so that one side of the slider 30 is pushed and the guide surface 32 is pressed against the first guide rail 111, causing the groove 31 to tilt. Or there is no push on one side of the slider 30 and the guide surface 32 does not abut the first guide rail 111, causing the groove 31 to face upward. In this embodiment, one side of the upper part of the slider 30 has a pressing surface 33, and the pressing surface 33 is located above the guide surface 32, but it is not limited to this.

Following the above, in this embodiment, the upper part of the slider 30 has a groove 31. The bottom of the groove 31 forms an elastic rib 312 and one side of the groove 31 forms a barb 311. The end surface of the elastic rib 312 is extended to below the barb 311, but not limited thereto.

Following the above, in this embodiment, the upper part of the slider 30 has a groove 31, so that the other side of the upper part of the slider 30 forms a guide block 34 and the other side of the groove 31 forms a pressing surface 313, and the side of the guide block 34 spans the second guide rail 112, but it is not limited to this.

Following the above, in this embodiment, the slider 30 has a sliding seat 35 on one side of the lower part. A sliding surface 351 is provided above the sliding seat 35, an inclined surface 350 is provided on the sliding seat 35 and is connected to and oblique to the sliding surface 351, and a clamping body 352 is provided below the sliding seat 35. The sliding surface 351 and the inclined surface 350 are located below the second guide rail 112 for cooperatively limiting an angle of rotation of the sliding seat 35. The clamping body 352 can clamp the other end of the elastic member 20, but it is not limited thereto.

The control rod 40 is formed in one piece and its material has elasticity. It is pivotally connected to the slider 30 and moves with the slider 30. The tail end of the control rod 40 has a hook portion 41 with a curved surface 411, so that the hook portion 41 has elastic restoring force. When the hook portion 41 passes through the lead-in slope R1 to the first guide slope R2, the hook portion 41 is locked at the locking point 121, or when the hook portion 41 passes through the second guide slope R3 to the lead-out slope R4, then the hook portion 41 is unlocked from the locking point 121, but is not limited to this. In this embodiment, the front end of the control rod 40 has a pivot hook 42 that is pivoted to a pivot hole 36 on the slider 30. Please refer to FIG. 1 again, but it is not limited thereto.

Figure 10:
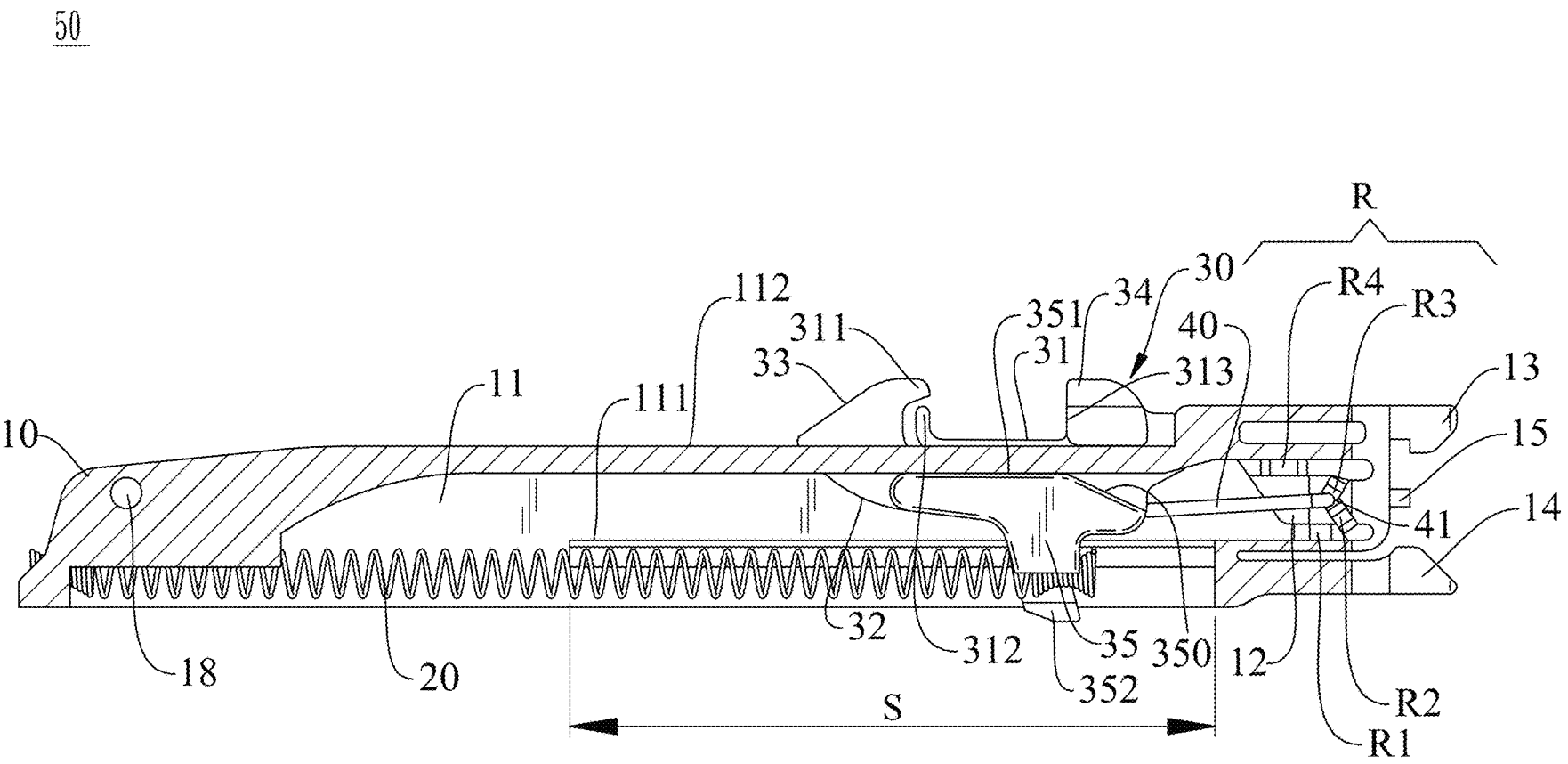
FIG. 10 is a cross-sectional view along line B-B in FIG. 9.
Figure 11:
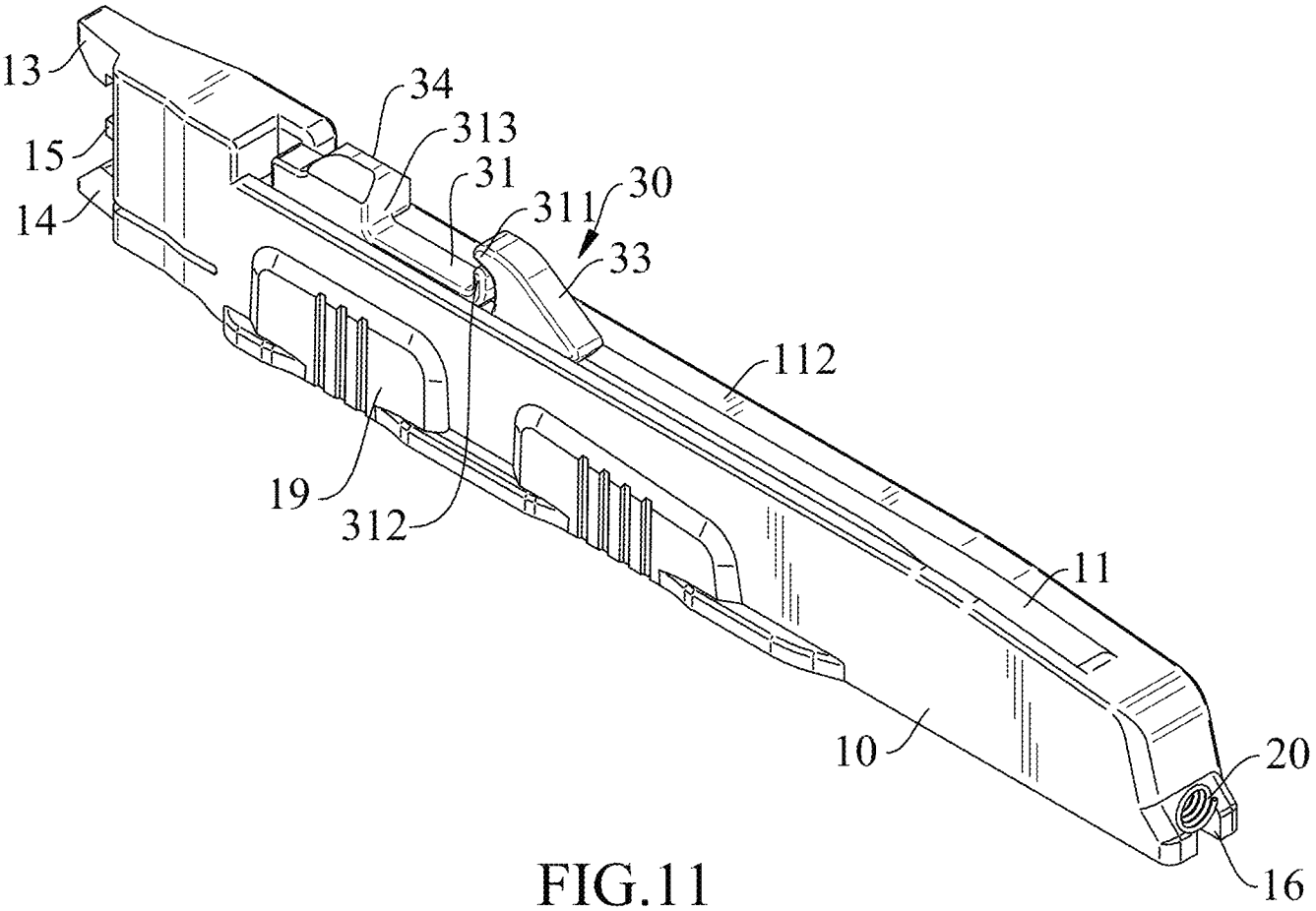
FIG. 11 is a combined three-dimensional view of the spring pressure device set of the present invention from another angle.
Figure 12:
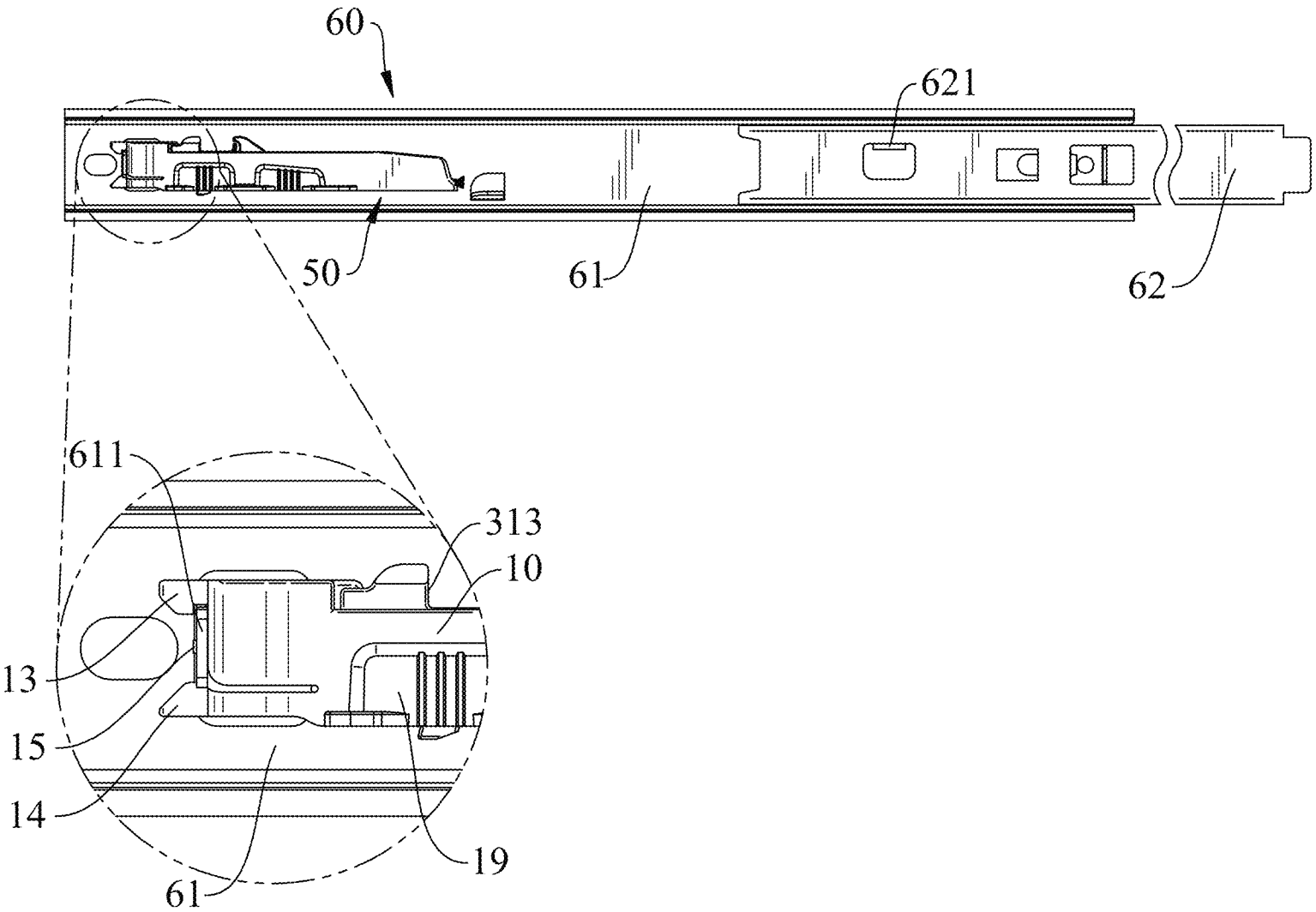
FIG. 12 is a schematic diagram of the spring pressure device set installed on the slide rail of the present invention.

As shown in FIGS. 1 and 10, the base member 10 is formed in one piece, which not only integrates the stroke path S and the step path R, but also quickly and easily assembles the elastic member 20, the slider 30, and the control rod 40 to the base member 10. Within the base member 10, the hook portion 41 can move from the stroke path S to the step path R. When the hook portion 41 deviates from the step path R, the elastic restoring force of the hook portion 41 causes the hook portion 41 to rebound to the step path R.

Referring to FIGS. 12-18, the invention also provides a slide rail assembly, which comprises the above-mentioned spring pressure device set 50 and a slide rail 60. The slide rail 60 comprises first rail 61 and a second rail 62. The first rail 61 is provided with the spring pressure device set 50 for fixation and the second rail 62 comprises an activating member 621. The activating member 621 can be a plate bent on the second rail 62. In this embodiment, the first rail 61 comprises a bending part 611, and the first fixing hook 13, the second fixing hook 14, and the positioning block 15 are combined on the bending part 611, so that the rear end of the base member 10 is fixed on the first rail 61, and the positioning member 17 and the fixing hole 18 are used to be combined with the first rail 61, so that the front part of the base member 10 is fixed on the first rail 61, so the spring pressure device set 50 can be stably installed on the first rail 61, but it is not limited to this.

Figure 8:
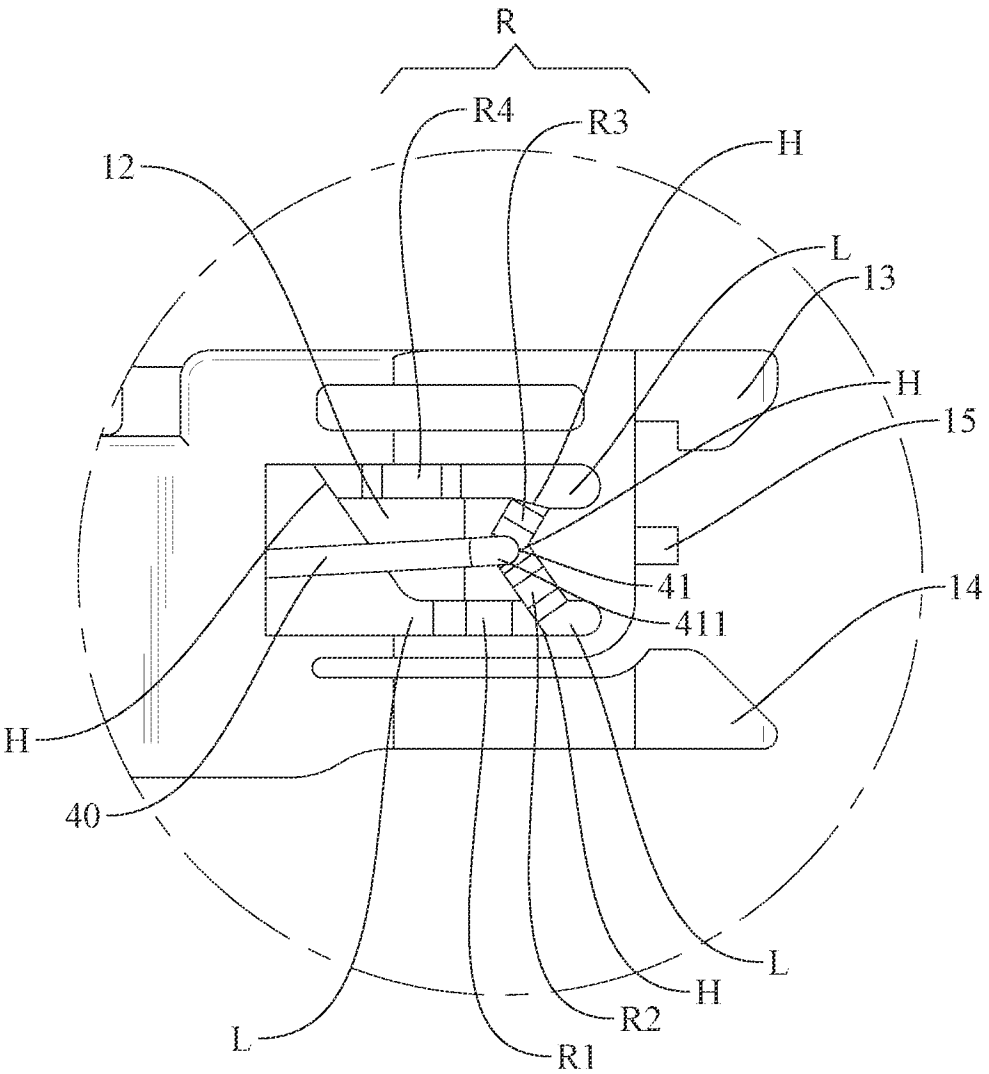
FIG. 8 is an enlarged view of Part 8 in FIG. 7.
Figure 9:
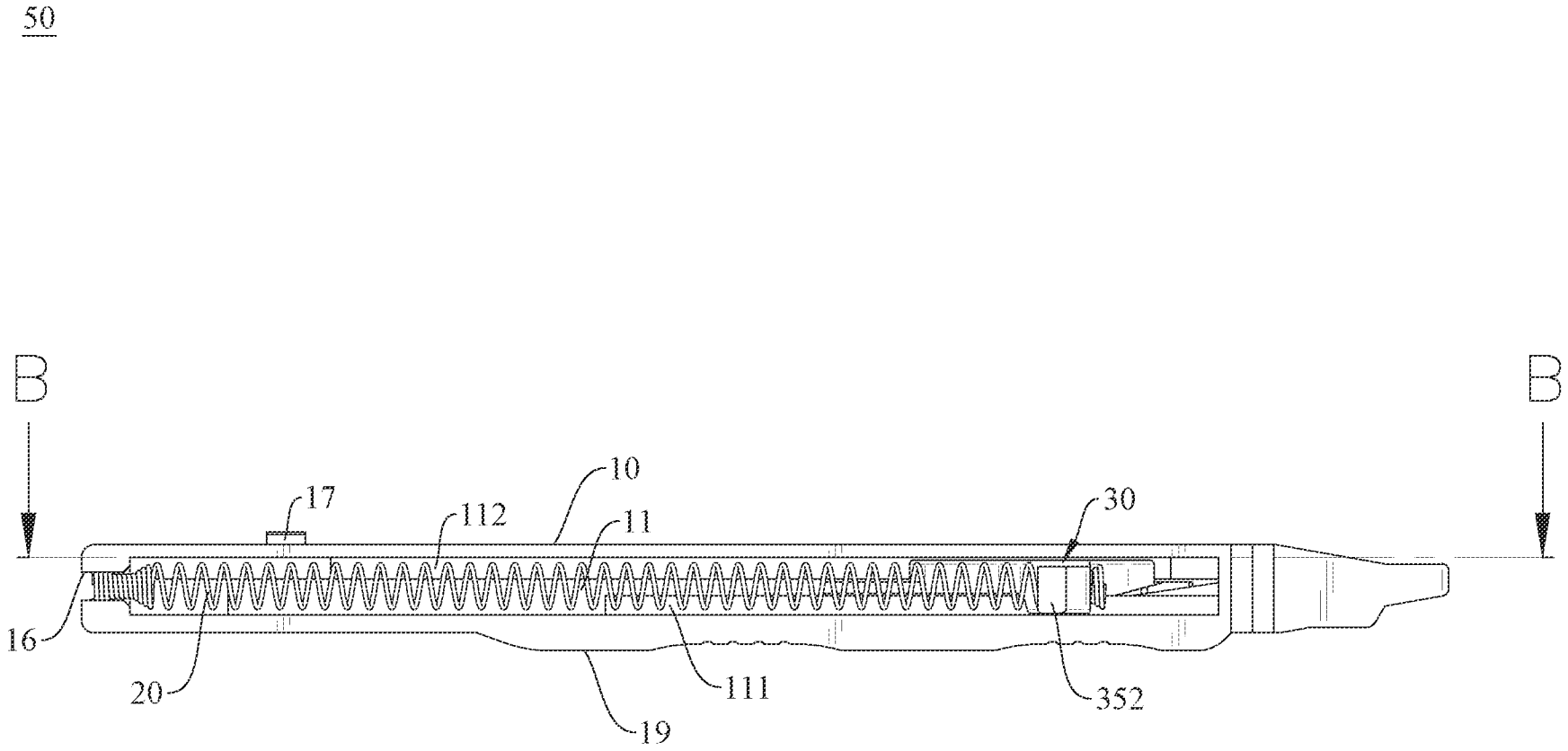
FIG. 9 is a bottom view of the slider of the present invention moving and the hook portion of the control rod locked at the locking point.
Figure 13:
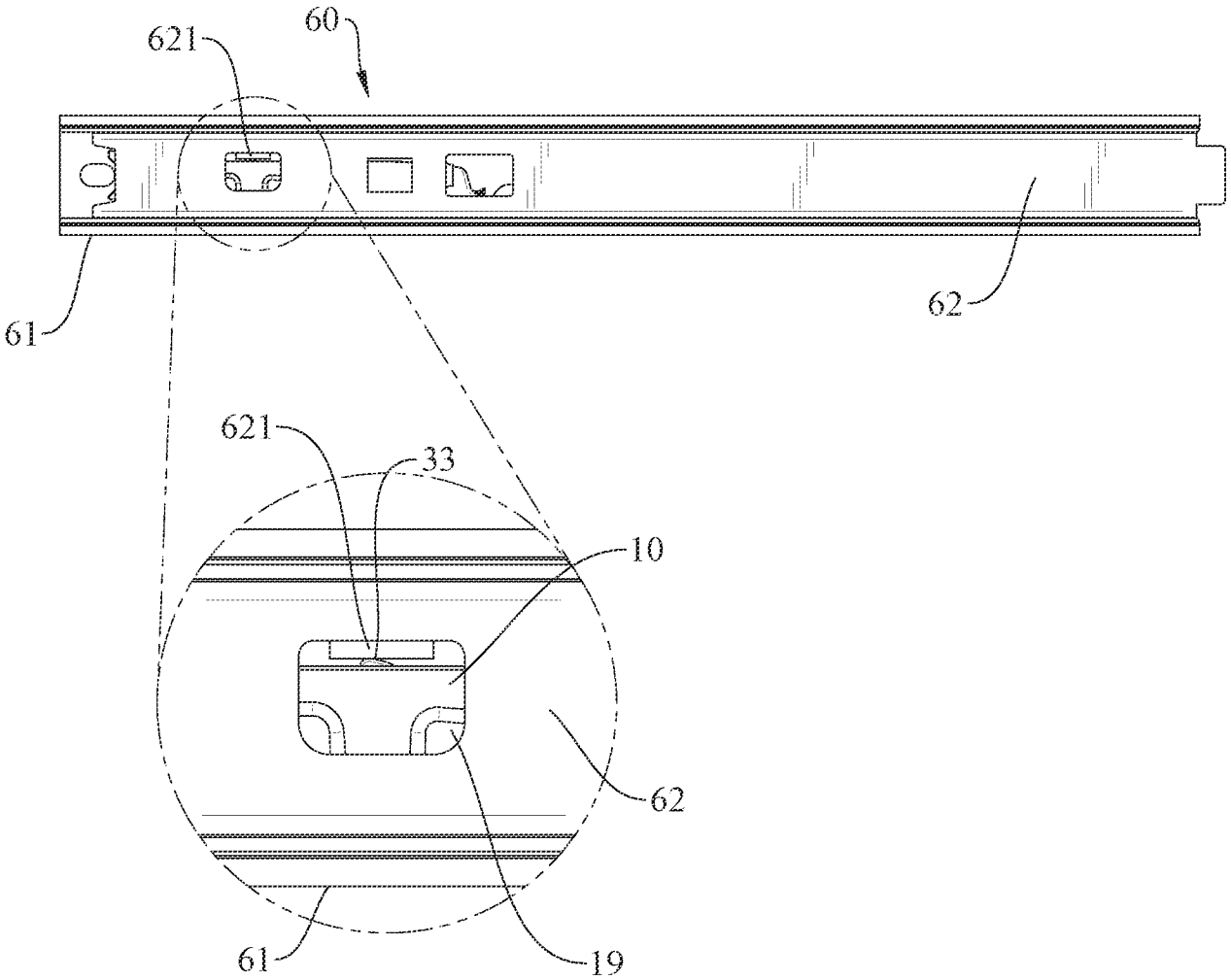
FIG. 13 is a schematic diagram of the present invention where the activating member of the second rail pushes the slider.
Figure 14:
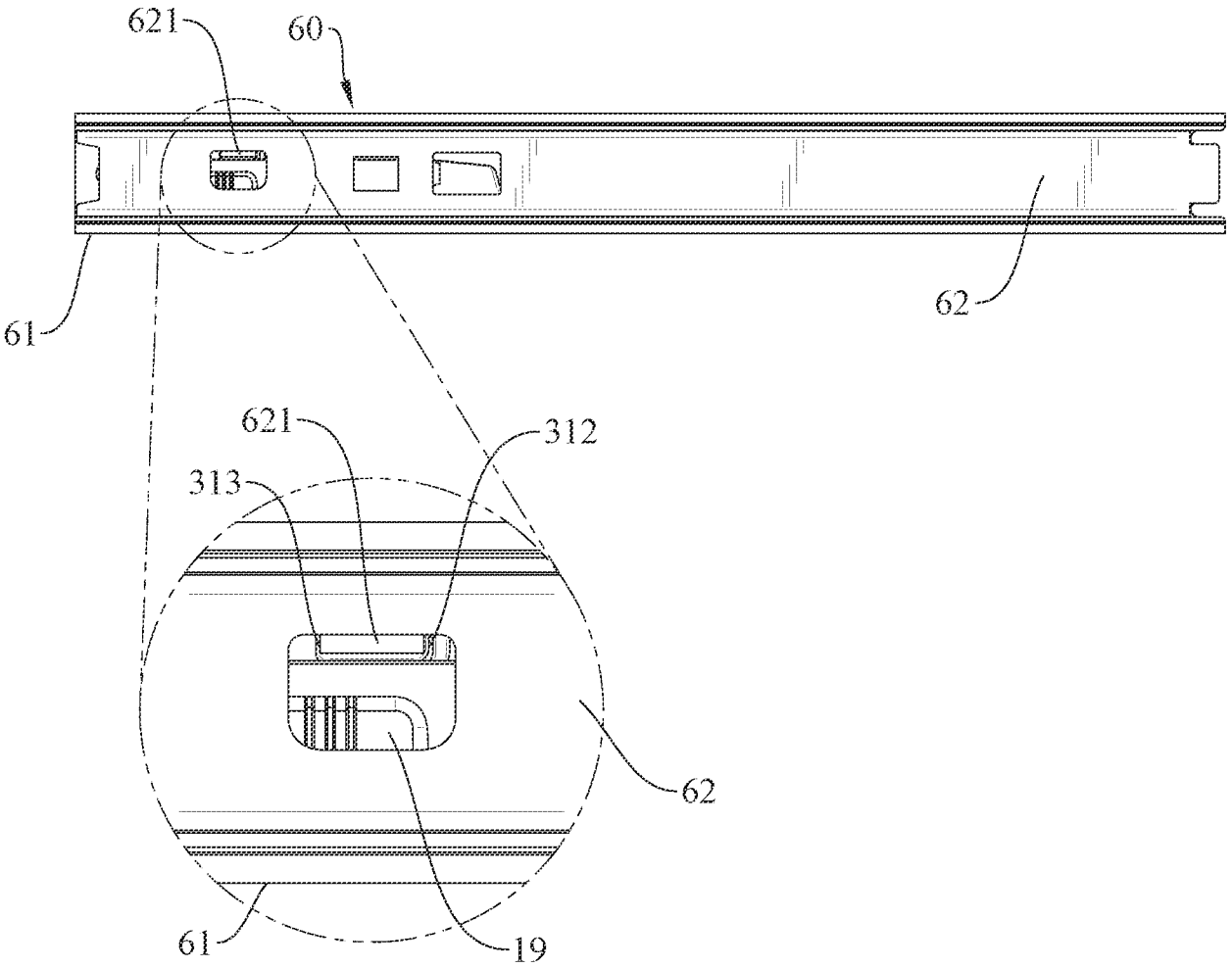
FIG. 14 is a schematic diagram of the activating member of the second rail of the present invention positioned in the groove of the slider.

As shown in FIGS. 13 and 14, when the second rail 62 is received into the first rail 61, the activating member 621 pushes one side of the slider 30 and the guide surface 32 abuts the first guide rail 111, in other words, the activating member 621 pushes the pressing surface 33 of the slider 30, causing the groove 31 to tilt. After the activating member 621 reaches the groove 31, one side of the slider 30 is not pressed and the guide surface 32 is not pressed against the first guide rail 111, in other words, the activating member 621 is not pressed against the pressing surface 33 of the slider 30, causing the groove 31 to face upward and position the activating member 621. In this embodiment, when the second rail 62 is received into the first rail 61, the activating member 621 drives the slider 30 to be locked at the locking point 121 with the hook portion 41. As shown in FIG. 8, the lead-in slope R1 can guide in the hook portion 41, and the first guide slope R2 can guide the hook portion 41 to be locked at the locking point 121.

Figure 15:
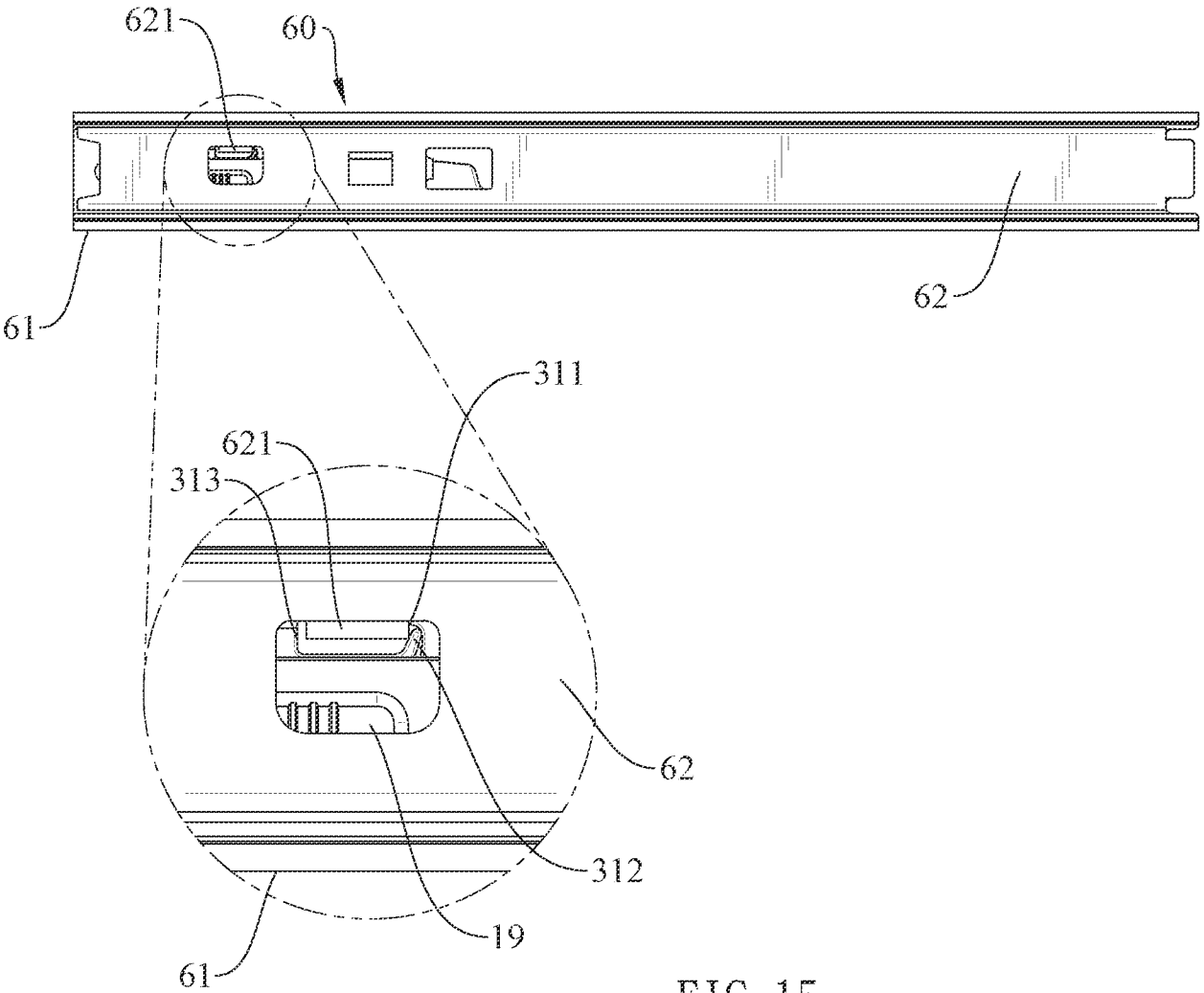
FIG. 15 is a schematic diagram of the elastic rib at the groove that is displaced by strong pulling of the activating member of the second rail of the present invention.
Figure 16:
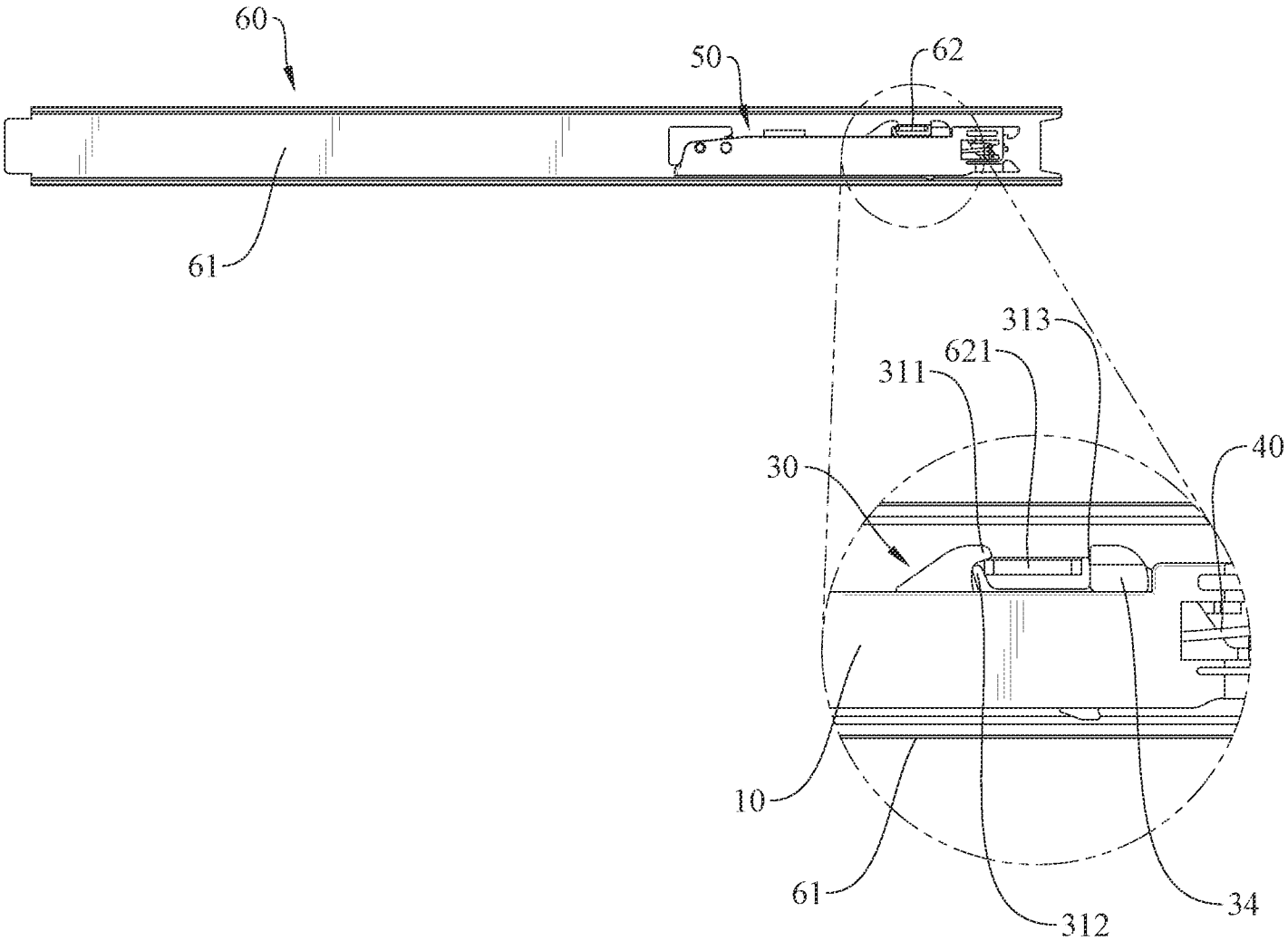
FIG. 16 is another schematic diagram of the elastic rib at the groove that is displaced by strong pulling of the activating member of the second rail of the present invention.

As shown in FIGS. 15 and 16, when the second rail 62 is strongly pulled on the first rail 61, the activating member 621 abuts the elastic rib 312, and the elastic rib 312 is displaced so that the barb 311 can hook the activating member 621 to form an overload mechanism, and it can be avoided that the hook portion 41 cannot be locked at the locking point 121.

Figure 4:
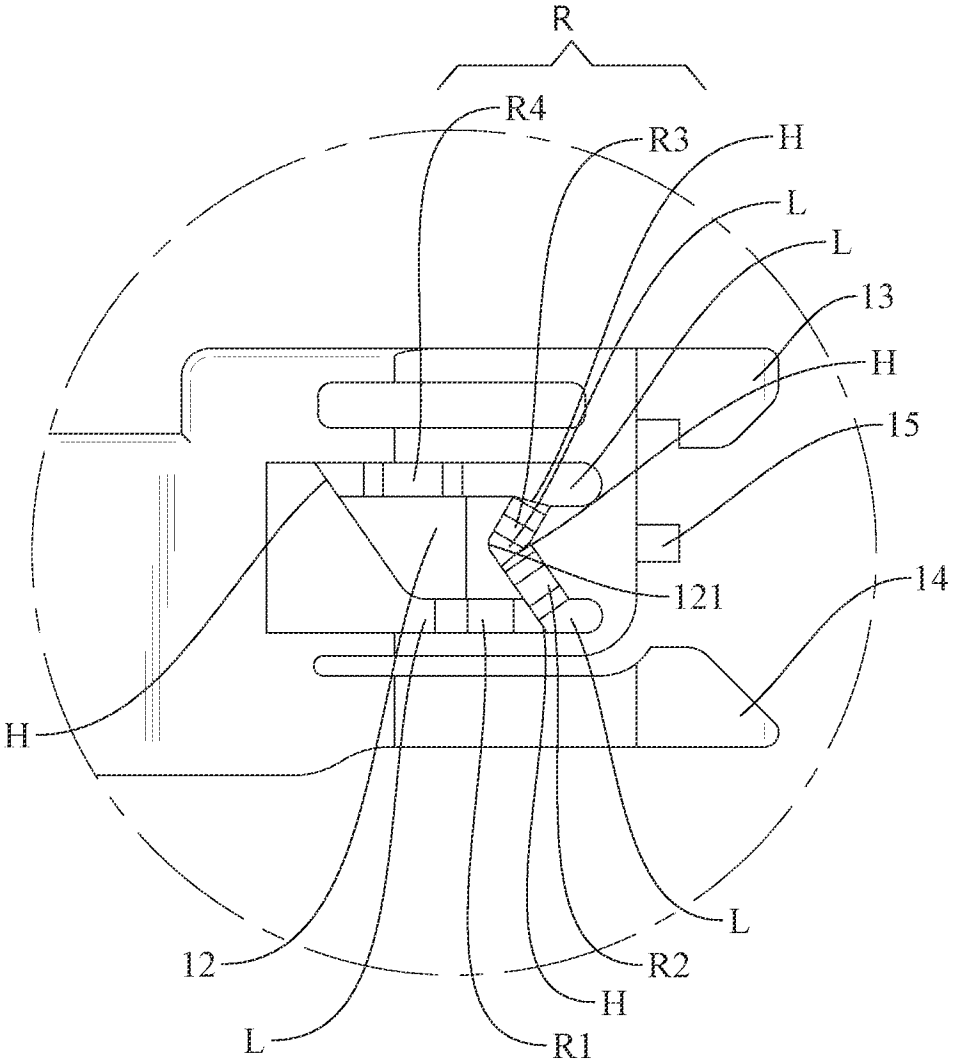
FIG. 4 is an enlarged view of Part 4 in FIG. 3.
Figure 5:
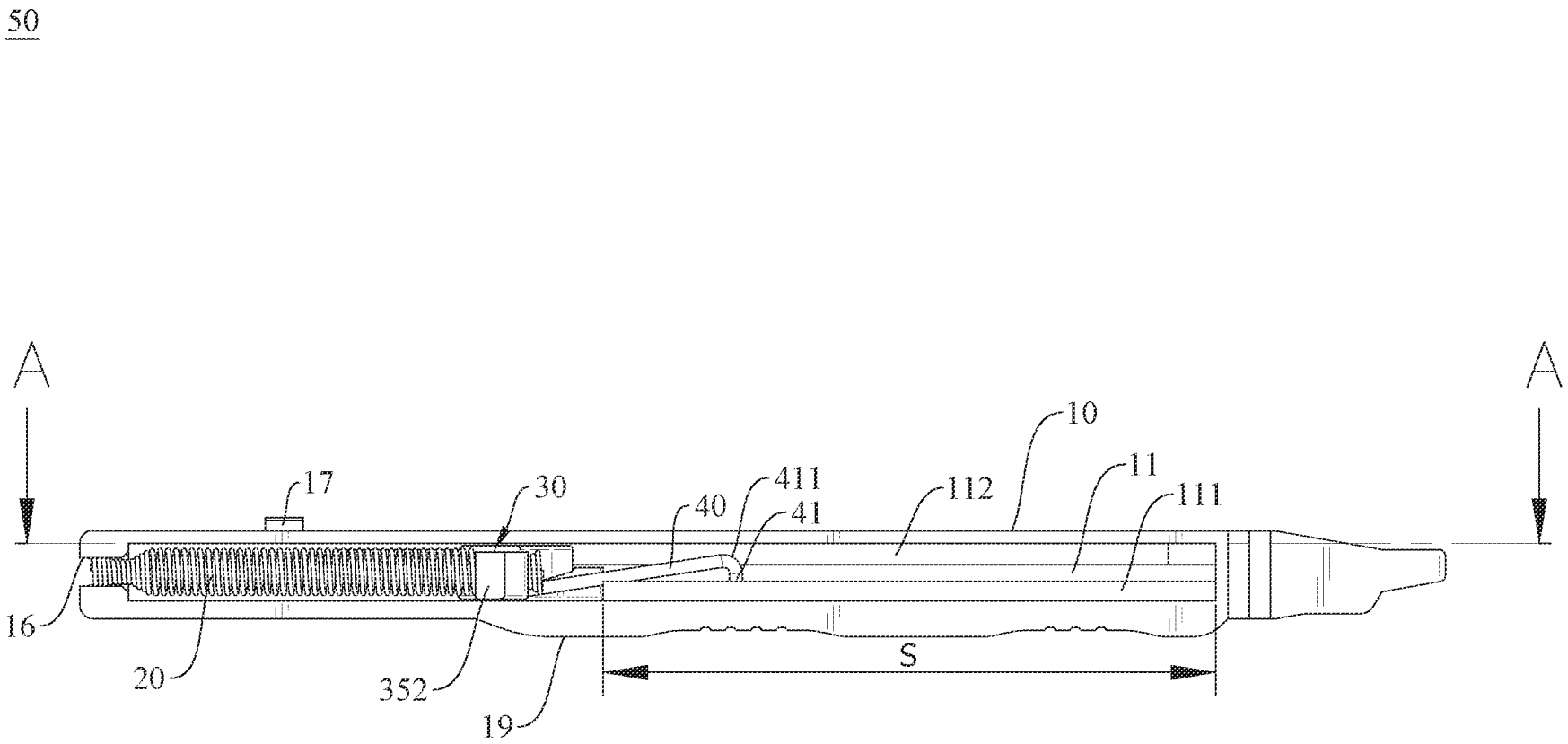
FIG. 5 is a bottom view of the slider of the present invention before it moves.
Figure 6:
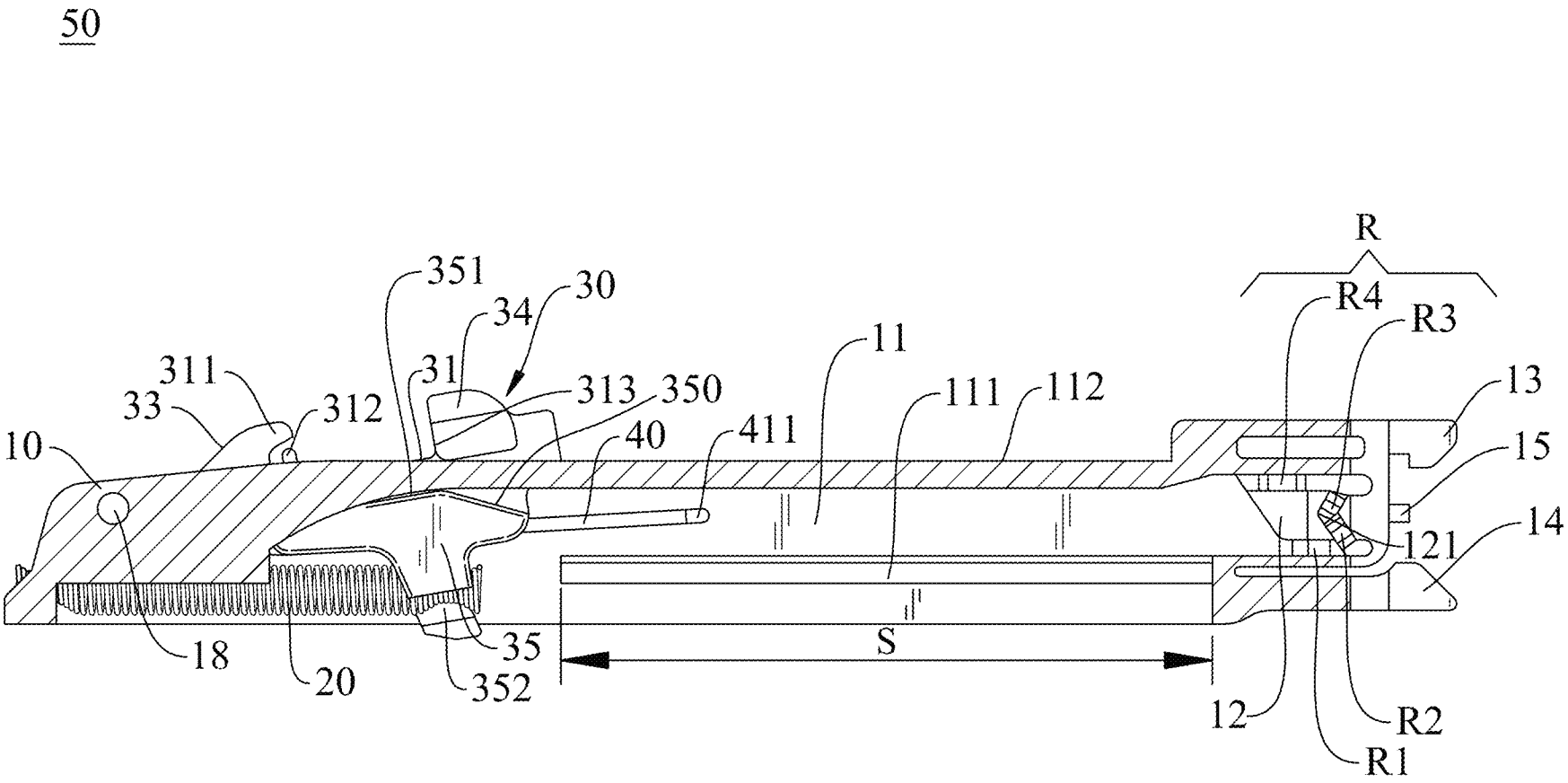
FIG. 6 is a cross-sectional view along line A-A in FIG. 5.
Figure 7:
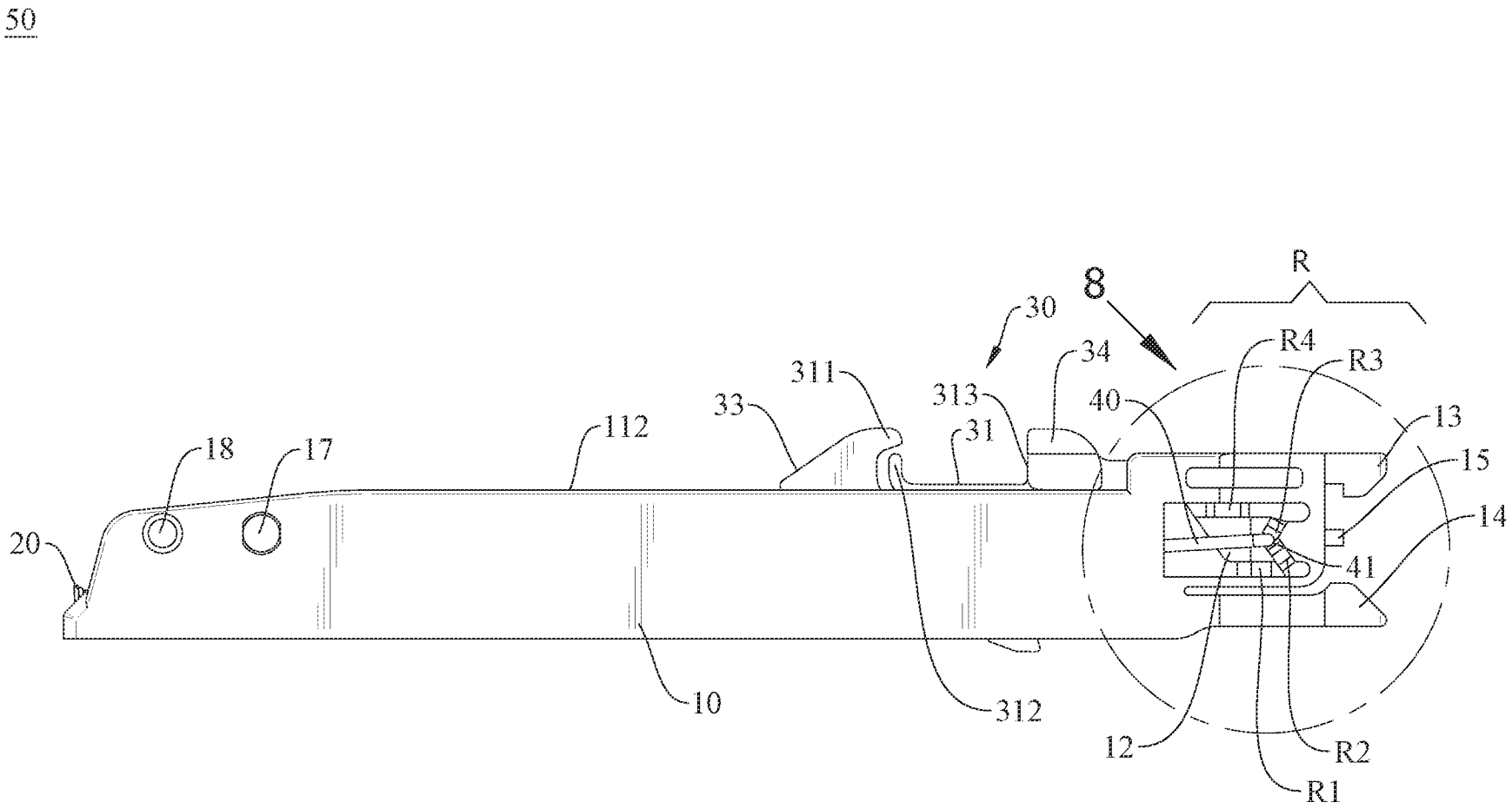
FIG. 7 is a schematic diagram of the present invention in which the slider moves and the hook portion of the control rod is locked at the locking point.
Figure 17:
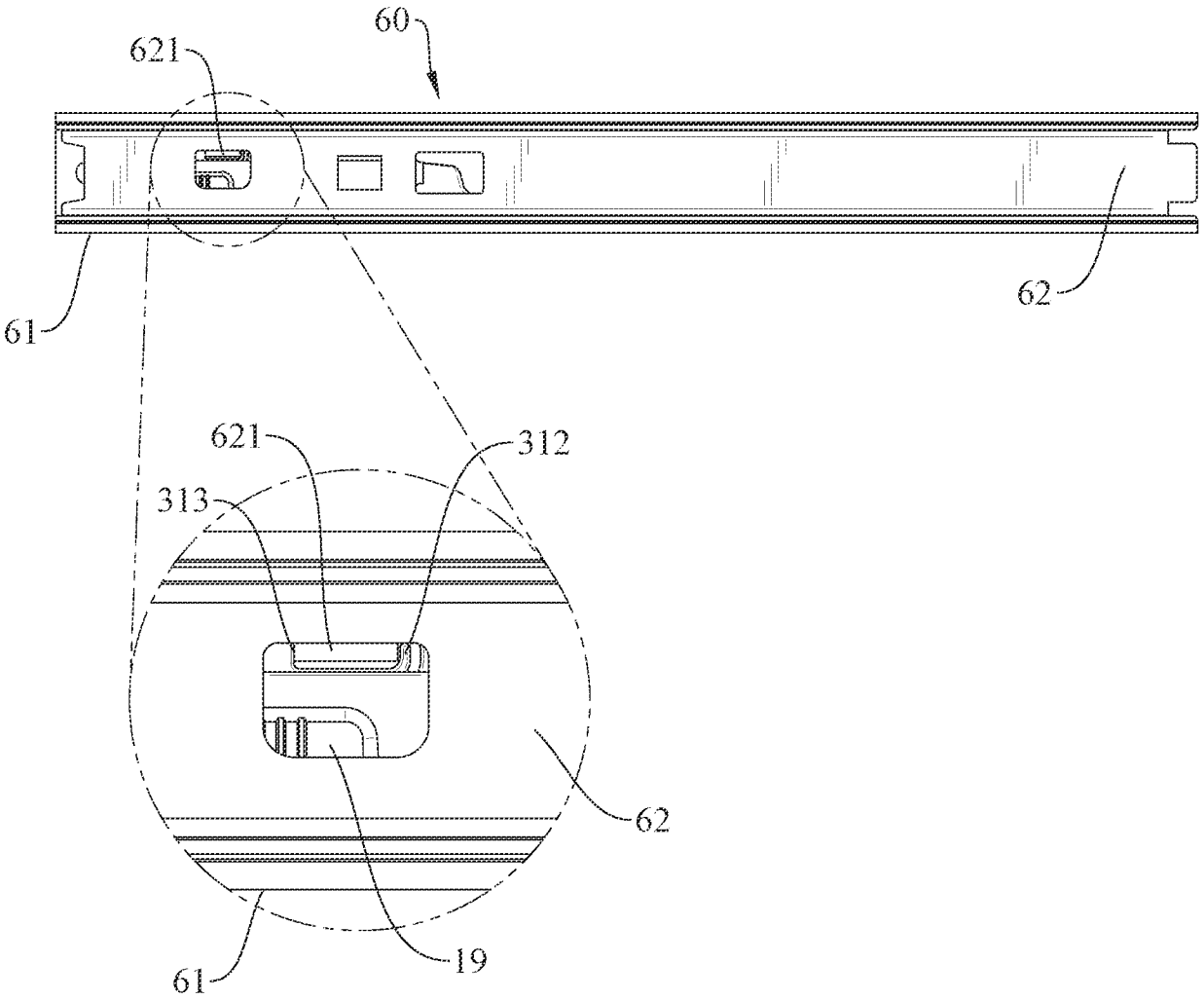
FIG. 17 is a schematic diagram of the pressing surface of the activating member of the second rail of the present invention pressing the groove.
Figure 18:
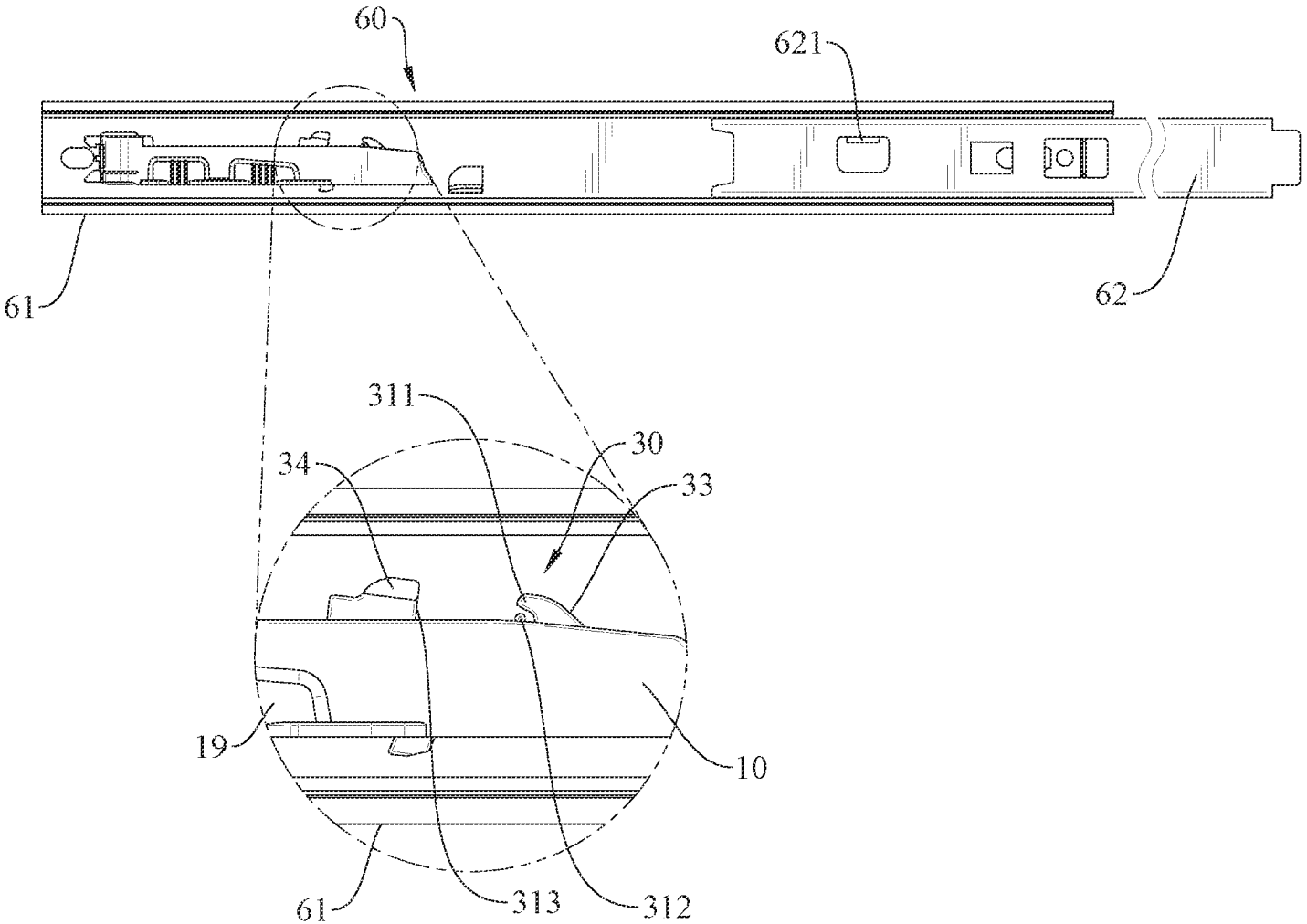
FIG. 18 is a schematic diagram of the slider popping up the second rail of the present invention.

As shown in FIGS. 17 and 18, when the second rail 62 is pushed, the activating member 621 pushes the slider 30 and the hook portion 41 is unlocked from the locking point 121, so that the elastic member 20 pops the slider 30 out of the second rail 62, that is, the slider 30 will return to its unmoved state. As shown in FIG. 4, the second guide slope R3 can guide the hook portion 41 to be unlocked from the locking point 121, and the lead-out slope R4 can guide the hook portion 41 out of the step path R.

What is claimed is:

1. A spring pressure device set for a slide rail, the slide rail including a first rail and a second rail, the second rail including an activating member, said spring pressure device set comprising:

a base member formed in one piece, said base member being adapted to be fixed on the first rail, and comprising a stroke space, a first guide rail located in said stroke space, a locking block with a locking point located on one side thereof, a stroke path formed on said first guide rail and a step path formed around said locking block, said stroke path continuing said step path;

an elastic member, said elastic member having one end thereof fixed on said base member;

a slider located in said base member and connected to an opposite end of said elastic member, said slider being slidable with a lower part thereof along said first guide rail in said stroke space; and a control rod formed of an elastic material in one piece and pivotally connected to said slider to move with said slider, said control rod comprising a hook portion with a curved surface at a tail end thereof so that said hook portion has elastic recovery force;

wherein said hook portion is movable from said stroke path to said step path, and when said hook portion deviates from said step path, the elastic restoring force of said hook portion rebounds said hook portion to said step path;

wherein a front end of said control rod has a pivot hook pivoted to a pivot hole on said slider;

wherein said step path comprises a lead-in slope, a first guide slope, a second guide slope and a lead-out slope so configured that when said hook portion passes through said lead-in slope to said first guide slope, said hook portion is locked at said locking point; when said hook portion passes through said second guide slope to said lead-out slope, said hook portion is unlocked from said locking point;

wherein said lead-in slope, said first guide slope, said second guide slope and said lead-out slope all have a transverse low section surface, a vertical high section surface, and a slope formed between said transverse low section surface and said vertical high section surface, so that a step difference is formed between said lead-in slope and said first guide slope, a step difference is formed between said first guide slope and said second guide slope, and a step difference is formed between said second guide slope and said lead-out slope;

wherein said slider comprises a groove located on an upper part thereof, an elastic rib formed on a bottom of said groove, and a barb formed on one side of said groove, said elastic rib having an end surface extended and bent below said barb;

wherein, when the second rail is received in the first rail, said slider is adapted to be driven by the activating member, and said hook portion is locked at said locking point;

wherein, when the second rail is pushed, said slider is pushed by the activating member, and said hook portion is unlocked at said locking point, causing said elastic member to pop said slider out of the second rail;

wherein said groove is facing upward and the activating member is positioned: when the second rail is forcefully pulled on the first rail, the activating member abuts said elastic rib, and said elastic rib is displaced so that said barb is capable of hooking the activating member; and wherein said base member further comprises a second guide rail parallel to said first guide rail, said slider further comprising a sliding seat located on the lower part thereof, said sliding seat comprising a sliding surface on a top side thereof, and an inclined surface connected to and oblique to said sliding surface, said sliding surface and said inclined surface being located below said second guide rail for cooperatively limiting an angle of rotation of said sliding seat.

2. The spring pressure device set as claimed in claim 1, wherein a distance between said first guide rail and said second guide rail forms said stroke space, so that said control rod is limited between said first guide rail and said second guide rail, and said second guide rail is capable of supporting an upper part of said slider, enabling the upper part of said slider to be guided by said second guide rail to move stably in said stroke space.

3. The spring pressure device set as claimed in claim 1, wherein said slider further comprises a guide surface located on the lower part thereof opposite to the upper part thereof; when said slider moves to stretch said elastic member, said hook portion is moved to lock at said locking point to generate elastic force on one side of said slider, so that one side of said slider is pushed and said guide surface is pressed against said first guide rail, causing said groove to tilt; and when there is no push on said one side of said slider, said guide surface is kept apart from said first guide rail, causing said groove to face upward.

4. The spring pressure device set as claimed in claim 1, wherein said base member further comprises a first fixing hook and a second fixing hook facing said first fixing hook at a rear end thereof, and a positioning block at the rear end of said base member between said first fixing hook and said second fixing hook.

5. The spring pressure device set as claimed in claim 2, wherein said slider comprises a guide block located at a rear side of said groove and a pressing surface adjacent to said groove, said guide block having one side thereof spanning said second guide rail.

6. The spring pressure device set as claimed in claim 3, wherein said slider further comprises a pressing surface located on one side of the upper part thereof above said guide surface.

7. The spring pressure device set as claimed in claim 3, wherein said sliding seat further comprises a clamping body on a bottom side thereof.

8. A slide rail assembly, comprising:

a spring pressure device set, said spring pressure device set comprising a base member formed in one piece, an elastic member, a slider located in said base member and a control rod formed of an elastic material in one piece, said base member comprising a stroke space, a first guide rail located in said stroke space, a locking block with a locking point located on one side thereof, a stroke path formed on said first guide rail and a step path formed around said locking block, said stroke path continuing said step path, said elastic member having one end thereof fixed on said base member and an opposite end thereof connected to said slider, said slider being slidable with a lower part thereof along said first guide rail in said stroke space, said control rod being pivotally connected to said slider to move with said slider, said control rod comprising a hook portion with a curved surface at a tail end thereof so that said hook portion has elastic recovery force, wherein said hook portion is movable from said stroke path to said step path, and when said hook portion deviates from said step path, the elastic restoring force of said hook portion rebounds said hook portion to said step path; and a slide rail, said slide rail comprising a first rail and a second rail, said first rail being provided with said spring pressure device set for fixation, said second rail comprising an activating member, wherein when said second rail is received in said first rail, said activating member drives said slider and said hook portion is locked at said locking point; and when said second rail is pushed, said activating member pushes said slider and said hook portion is unlocked at the locking point, causing said elastic member to pop said slider out of said second rail;

wherein a front end of said control rod has a pivot hook pivoted to a pivot hole on said slider;

wherein said step path comprises a lead-in slope, a first guide slope, a second guide slope and a lead-out slope so configured that when said hook portion passes through said lead-in slope to said first guide slope, said hook portion is locked at said locking point: when said hook portion passes through said second guide slope to said lead-out slope, said hook portion is unlocked from said locking point;

wherein said lead-in slope, said first guide slope, said second guide slope and said lead-out slope all have a transverse low section surface, a vertical high section surface, and a slope formed between said transverse low section surface and said vertical high section surface, so that a step difference is formed between said lead-in slope and said first guide slope, a step difference is formed between said first guide slope and said second guide slope, and a step difference is formed between said second guide slope and said lead-out slope;

wherein said slider comprises a groove located on an upper part thereof, an elastic rib formed on a bottom of said groove, and a barb formed on one side of said groove, said elastic rib having an end surface extended and bent below said barb, and said groove is facing upward and said activating member is positioned; and when said second rail is forcefully pulled on said first rail, said activating member abuts said elastic rib, and said elastic rib is displaced so that said barb is capable of hooking said activating member; and wherein said base member further comprises a second guide rail parallel to said first guide rail, said slider further comprising a sliding seat located on the lower part thereof, said sliding seat comprising a sliding surface on a top side thereof, and an inclined surface connected to and oblique to said sliding surface, said sliding surface and said inclined surface being located below said second guide rail for cooperatively limiting an angle of rotation of said sliding seat.

9. The slide rail assembly as claimed in claim 8, wherein said slider further comprises a guide surface located on the lower part thereof opposite to the upper part thereof; when said slider moves to stretch said elastic member, said hook portion is moved to lock at said locking point to generate elastic force on one side of said slider, so that one side of said slider is pushed and said guide surface is pressed against said first guide rail, causing said groove to tilt; and after said activating member reaches said groove, one side of said slider is released from the push force and the guide surface is kept away from said first guide rail, so that said groove appears upward and said activating member is positioned.

10. The slide rail assembly as claimed in claim 8, wherein said base member further comprises a first fixing hook and a second fixing hook facing said first fixing hook at a rear end thereof, and a positioning block at the rear end of said base member between said first fixing hook and said second fixing hook; said first rail comprises a bending part; and said first fixing hook, said second fixing hook and said positioning block are combined on said bending part, so that said base member has a rear end thereof fixed on said first rail.

* * * * *